US008579400B2

(12) United States Patent
Fuse et al.

(10) Patent No.: US 8,579,400 B2
(45) Date of Patent: Nov. 12, 2013

(54) INFORMATION PROCESSING APPARATUS AND INFORMATION PROCESSING METHOD

(75) Inventors: Koji Fuse, Tokyo (JP); Takashi Ochiai, Machida (JP)

(73) Assignee: Canon Kabushiki Kaisha, Tokyo (JP)

( * ) Notice: Subject to any disclaimer, the term of this patent is extended or adjusted under 35 U.S.C. 154(b) by 548 days.

(21) Appl. No.: 12/853,578

(22) Filed: Aug. 10, 2010

(65) Prior Publication Data

US 2011/0043561 A1 Feb. 24, 2011

(30) Foreign Application Priority Data

Aug. 20, 2009 (JP) ..... 2009-191076

(51) Int. Cl.
*B41J 29/38* (2006.01)

(52) U.S. Cl.
USPC ..... 347/14

(58) Field of Classification Search
USPC ..... 347/14
See application file for complete search history.

(56) References Cited

U.S. PATENT DOCUMENTS

2003/0214554 A1* 11/2003 Tschida ..... 347/42
2007/0070107 A1* 3/2007 Shamoun et al. ..... 347/14
2007/0109343 A1* 5/2007 Geurts ..... 347/19

FOREIGN PATENT DOCUMENTS

JP 2002-292859 A 10/2002
JP 2003-285434 A 10/2003

* cited by examiner

*Primary Examiner* — Laura Martin
(74) *Attorney, Agent, or Firm* — Canon USA, Inc., IP Division

(57) ABSTRACT

An information processing apparatus is provided for a recording apparatus that records an image on a recording medium using a recording head. The recording head includes recording element arrays arranged in parallel, and in which recording elements that discharge recording material are aligned. The information processing apparatus includes an acquisition unit and a setting unit. The acquisition unit acquires displacement information of an impact position of the recording material recorded by at least one of the recording element arrays. The setting unit sets a distribution rate of the recording material for each recording element array according to the displacement information.

7 Claims, 16 Drawing Sheets

FIG.14

| | RECORDING ELEMENT ARRAY 1 | RECORDING ELEMENT ARRAY 2 | RECORDING ELEMENT ARRAY 3 | RECORDING ELEMENT ARRAY 4 |
|---|---|---|---|---|
| RECORDING RATE (%) | 40 | 10 | 30 | 20 |

FIG.15

| | RECORDING ELEMENT ARRAY 1 | RECORDING ELEMENT ARRAY 2 | RECORDING ELEMENT ARRAY 3 | RECORDING ELEMENT ARRAY 4 |
|---|---|---|---|---|
| RECORDING RATE (%) | 40 | 30 | 10 | 20 |

INFORMATION PROCESSING APPARATUS AND INFORMATION PROCESSING METHOD

BACKGROUND OF THE INVENTION

1. Field of the Invention

The present invention relates to an information processing apparatus and an information processing method for a recording apparatus that records an image on a recording medium using a recording head.

2. Description of the Related Art

A recording apparatus is a device that records an image (including characters and symbols) on a recording medium, such as paper, based on recording information. Such a recording apparatus may be used as a printer, a copying machine, or as an output device of an integrated electronic device, where the integrated electronic device includes a computer and a word processor or a workstation. The recording apparatus is classified into an inkjet type, a wire dot type, a thermal type, and a laser beam type according to the employed recording method.

Among the various types of recording apparatuses, the inkjet type recording apparatus (i.e., an inkjet recording apparatus) employs an inkjet recording head (hereinafter referred to as a recording head) as a recording unit. The inkjet recording apparatus records by discharging ink from discharge ports in the recording head to the recording medium.

Such an inkjet recording apparatus is beneficial in that the size of the recording head easily can be reduced, and a high-quality image can be formed at high speed. Further, the inkjet recording apparatus is capable of recording on plain paper without a need for special processing, so that running cost is low.

Furthermore, since the inkjet recording apparatus employs a non-impact printing method, little noise is generated. Moreover, it is easy for the inkjet recording apparatus to form a color image using a variety of inks colors, and to record an image on a large size recording medium.

A serial type inkjet recording apparatus records by scanning in a main scanning direction perpendicular to a direction in which the recording medium is conveyed (i.e., a sub-scanning direction). Such a serial type inkjet recording apparatus records the image using a recording head that moves along the recording medium. More specifically, the serial type recording apparatus records on the entire area of the recording medium by repeating an operation of conveying the recording medium by a predetermined amount each time the recording head ends recording once in the main scanning direction.

On the other hand, in a full line type inkjet recording apparatus, a recording width of the recording head corresponds to a width of the recording medium, and recording is performed only by a movement in the conveying direction of the recording medium. In such a full line type inkjet recording apparatus, the recording medium is set at a predetermined position, and the recording apparatus continuously records one line at a time by conveying the recording medium.

As a result, the full line type inkjet recording apparatus records on the entire area of the recording medium. The full line type inkjet recording apparatus is capable of forming the image at higher speed. In response, the full line type inkjet recording apparatus is receiving attention as a recording apparatus for performing on-demand recording, which is recently in high needs. Such a full line type inkjet recording apparatus is discussed in Japanese Patent Application Laid-Open No. 2002-292859.

If the full line type recording apparatus is to be used in on-demand recording, it generally is necessary to record on an A3 size recording medium at a print speed of 30 pages or more per minute with a high resolution of 600 dots per inch (dpi)×600 dpi or greater. Further, it generally is necessary to record a full-color image such as a photograph on the A3 size recording medium at the print speed of 30 pages or more per minute with a high resolution of 1200 dpi×1200 dpi or greater.

If the above-described full line type recording apparatus forms a high-duty image using one recording element array, ink droplets discharged from the adjacent recording elements undesirably may combine on the recording medium, depending on the amount of ink in the ink droplet. In such a case, an inappropriate shape may be formed on the recording medium, and may lead to deterioration of the formed image.

To solve such a problem, a multiple array head may be used as the recording head for the full line type inkjet recording apparatus. The multiple array head is a recording head having recording element arrays that discharge ink droplets of the same color and are arranged in parallel. The number of ink droplets discharged at the same time is reduced by discharging ink of the same color using multiple recording element arrays, so that combining of the ink droplets can be reduced.

In the full line type recording apparatus, the inkjet recording elements are positioned across the full-width of the recording area of the recording medium. Conventionally, these inkjet recording elements are difficult to manufacture without defect. In particular, it is currently difficult to manufacture without defect all discharge ports configuring a portion of the inkjet recording element.

For example, if the full line type recording apparatus is to record on the A3 size paper with a resolution of 1200 dpi, it is necessary to form approximately 14,000 discharge ports (recording width approximately 280 mm) in the full line type recording head. It is thus difficult to manufacture such a large number of discharge ports without defect. Even when such a recording head can be manufactured, yield rate becomes low and manufacturing cost becomes large.

To solve such a problem, an elongated joint head may be used as the full line type recording head. The joint head is a recording head in which recording chips are arranged in a direction of the discharge port arrays that are included in the recording chip. The recording elements are aligned in the discharge port array. In other words, the elongated recording head is formed by accurately arranging low cost short chips used in the serial type recording apparatus, to be connected in the direction in which the discharge port arrays are arranged.

The multiple array head and the joint head are described above as the recording heads for the full line type recording apparatus. The serial type recording apparatus also may use such recording heads for performing recording.

However, the above-described multiple array head may generate periodical density unevenness on the recording medium due to a periodical position change of the recording head with respect to the recording medium arising from the configuration thereof. The periodical density unevenness is a density change, which is generated periodically in a direction perpendicular to the direction in which the recording element arrays are arranged. In a case of the full line type printer, meandering of the recording medium when being conveyed generates the periodical position change of the recording head with respect to the recording medium. In the case of the serial type printer, vibration of the recording head generates the periodical position change.

FIG. 1 illustrates an example of the periodical position change of the multiple array head, i.e., the recording head, with respect to the recording medium. FIG. 2 illustrates an example of impact positions of the ink dots discharged from each of the recording elements in the recording head. FIG. 3 illustrates an example of a distance between the impact positions of the ink dots discharged from each of the recording elements in the recording head.

Referring to FIG. 1, the multiple array head, i.e., a recording head, includes a recording element P1 and a recording element P2. It is assumed that the positions of the recording element P1 and the recording element P2 with respect to the recording medium change in a sine wave shape as illustrated in FIG. 2. In such a case, the distance between the impact positions of the ink dots discharged from the recording element P1 and the recording element P2 changes according to the position in an X-direction as illustrated in FIG. 3.

Further, it is assumed that the recording element other than the recording element P1 in a recording element array 1 and the recording element in a recording element array 2, whose position in the X-direction is the same as the other recording element discharge the ink dots. In such a case, the distance between the impact positions similarly changes according to the position in the X-direction as illustrated in FIG. 3. Such a change in the distance causes the periodical density unevenness in the image recorded on the recording medium.

Furthermore, the above-described joint head tends to periodically generate a line on the recording medium at a joint portion by the periodical position change of the recording head with respect to the recording medium arising from the configuration thereof. Such a line is the density change that is periodically generated at the joint portion in the direction perpendicular to the direction in which the recording element arrays are arranged.

FIG. 4 is a schematic diagram illustrating an example of the periodical position change of the joint head, i.e., the recording head, with respect to the recording medium.

Referring to FIG. 4, it is assumed that the positions of the recording element P1 and the recording element P2 in the joint head with respect to the recording medium change in the sine wave shape as illustrated in FIG. 2. In such a case, the distance between the impact positions of the ink dots discharged from the recording element P1 and the recording element P2 changes according to the positions in the X-direction as illustrated in FIG. 3.

Further, it is assumed that the recording element other than the recording element P1 in the joint portion of the recording element array 1 illustrated in FIG. 4 and the recording element in the joint portion of the recording element array 2, whose position in the X-direction is the same as the other recording element discharge ink dots. In such a case, the distance between the impact positions similarly changes according to the position in the X-direction as illustrated in FIG. 3. The change of distance causes periodic line in the image recorded on the recording medium at the joint portion.

SUMMARY OF THE INVENTION

The present invention is directed to an information processing apparatus and an information processing method for forming a recording image on the recording medium while reducing generation of the periodical density change based on the periodical position change of the recording head with respect to the recording medium.

According to an aspect of the present invention, an information processing apparatus is provided for a recording apparatus that records an image on a recording medium using a recording head. The recording head includes recording element arrays arranged in parallel, and in which recording elements that discharge recording material are aligned. The information processing apparatus includes an acquisition unit and a setting unit. The acquisition unit acquires displacement information of an impact position of the recording material recorded by at least one the recording element arrays. The setting unit sets a distribution rate of the recording material for each recording element array according to the displacement information.

According to another aspect of the present invention, an information processing method is provided for a recording apparatus that records an image on a recording medium using a recording head. The recording head includes recording element arrays arranged in parallel, and in which recording elements that discharge recording material are aligned. The information processing method includes acquiring displacement information of an impact position of the recording material recorded by at least one of the recording element arrays. The information processing method also includes setting a distribution rate of the recording material for each recording element array according to the displacement information.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 14 illustrates an example of a table for setting a recording rate with respect to a recording medium to each of the recording element arrays illustrated in FIG. 12.

FIG. 15 illustrates an example of a table for setting a recording rate with respect to a recording medium to each of the recording element arrays illustrated in FIG. 13.

DESCRIPTION OF THE EMBODIMENTS

Various exemplary embodiments, features, and aspects of the invention will be described in detail below with reference to the drawings.

Before describing an exemplary embodiment of the present invention in detail, an outline of the present exemplary embodiment for reducing, when forming (recording) the recording image on the recording medium, the periodical density change generated due to the periodical position change of the recording head with respect to the recording medium will be described below.

Figure 1:
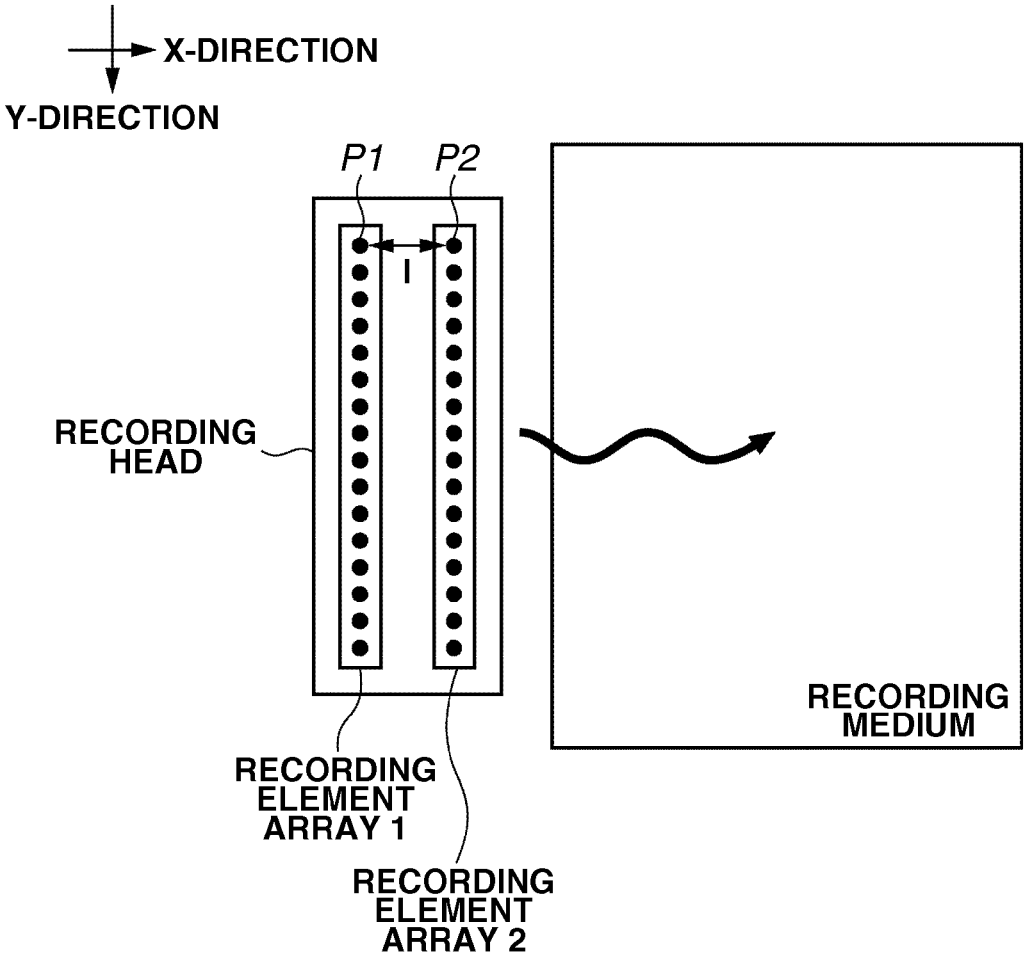
FIG. 1 illustrates an example of a periodical position change of a multiple array head, i.e., a recording head, with respect to a recording medium.
Figure 2:
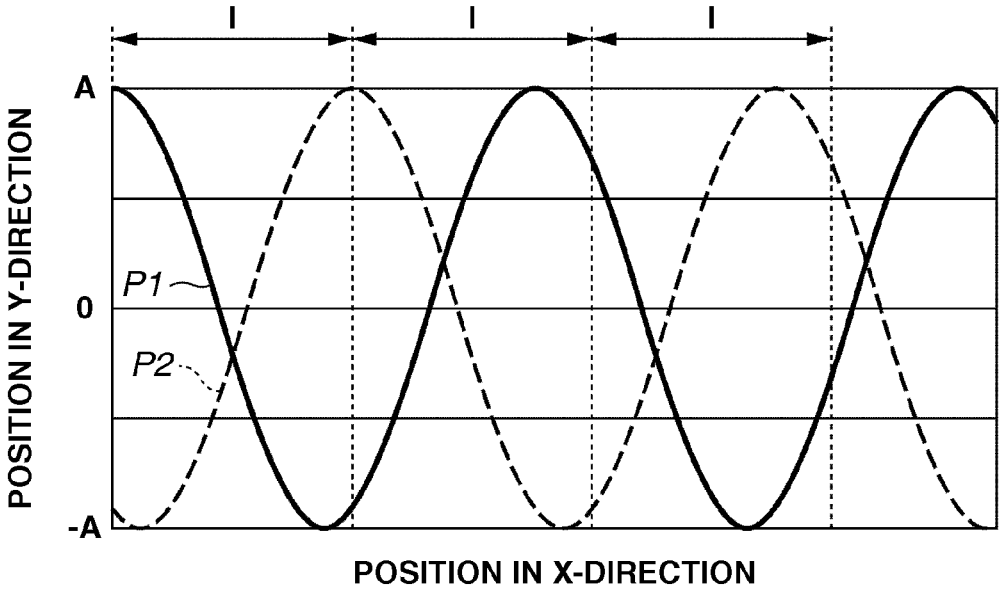
FIG. 2 illustrates an example of impact positions of ink dots discharged by each recording element of the recording head illustrated in FIG. 1.
Figure 3:
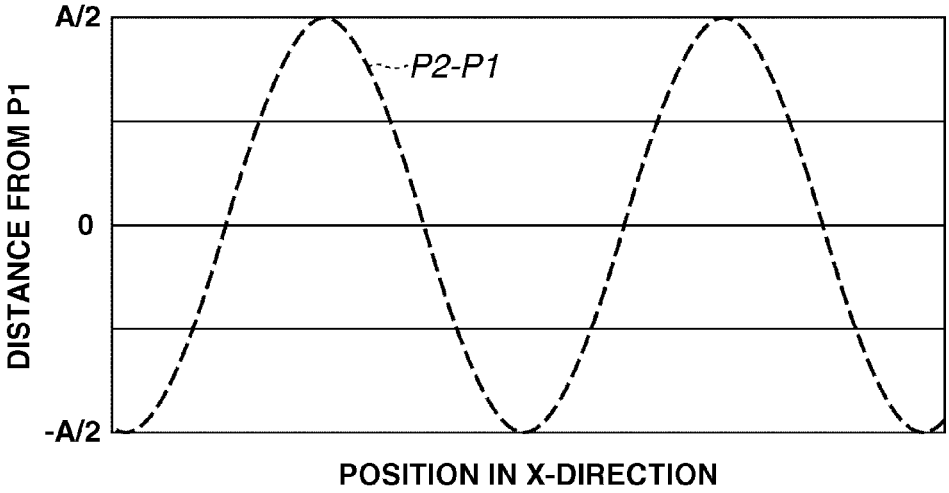
FIG. 3 is an example of a distance between impact positions of the ink dots discharged by each recording element of the recording head illustrated in FIG. 1.

FIG. 1 illustrates an example of the multiple array head in which two recording element arrays are arranged in parallel. When the recording apparatus records using the multiple head in which three or more recording element arrays are arranged in parallel, recording rates of each recording element arrays with respect to the recording medium, in which periodic density unevenness becomes unnoticeable, are different according to the period of the position change of the recording head with respect to the recording medium.

Figure 4:
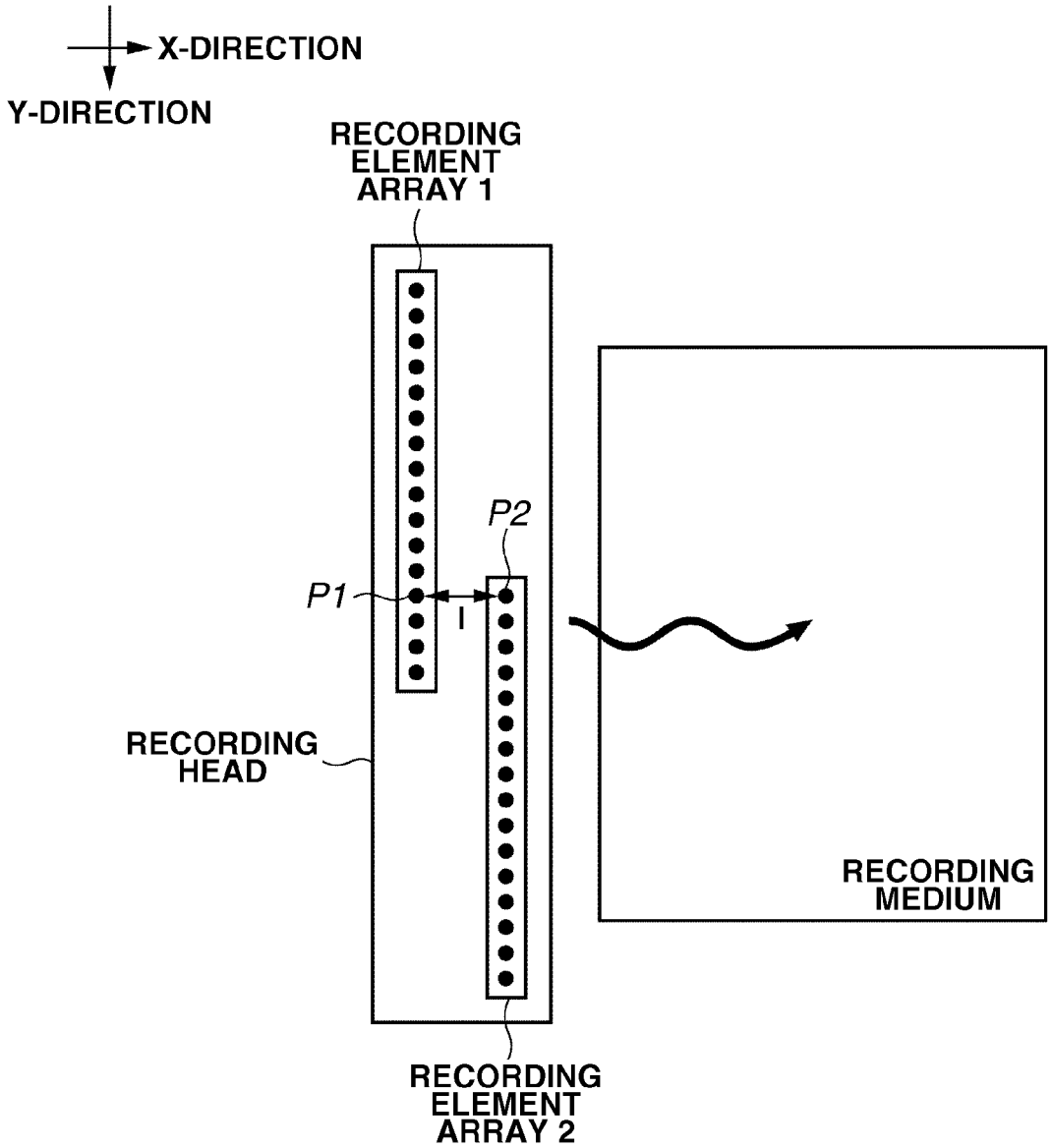
FIG. 4 is an example of a periodical position change in a joint head, i.e., a recording head, with respect to a recording medium.

Further, FIG. 4 illustrates an example of the joint head in which there are two recording element arrays that overlap at the joint portion. When the joint head, in which there are three or more recording element arrays that are overlapping at the joint portion, is used to record the image, recording rate of each recording element array with respect to the recording medium, in which periodic density unevenness becomes unnoticeable, are different according to the period of the position change of the recording head with respect to the recording medium.

A first exemplary embodiment of the present invention will be described below with reference to the drawings.

<A Configuration of a Printer Unit in the Recording Apparatus>

Figure 5:
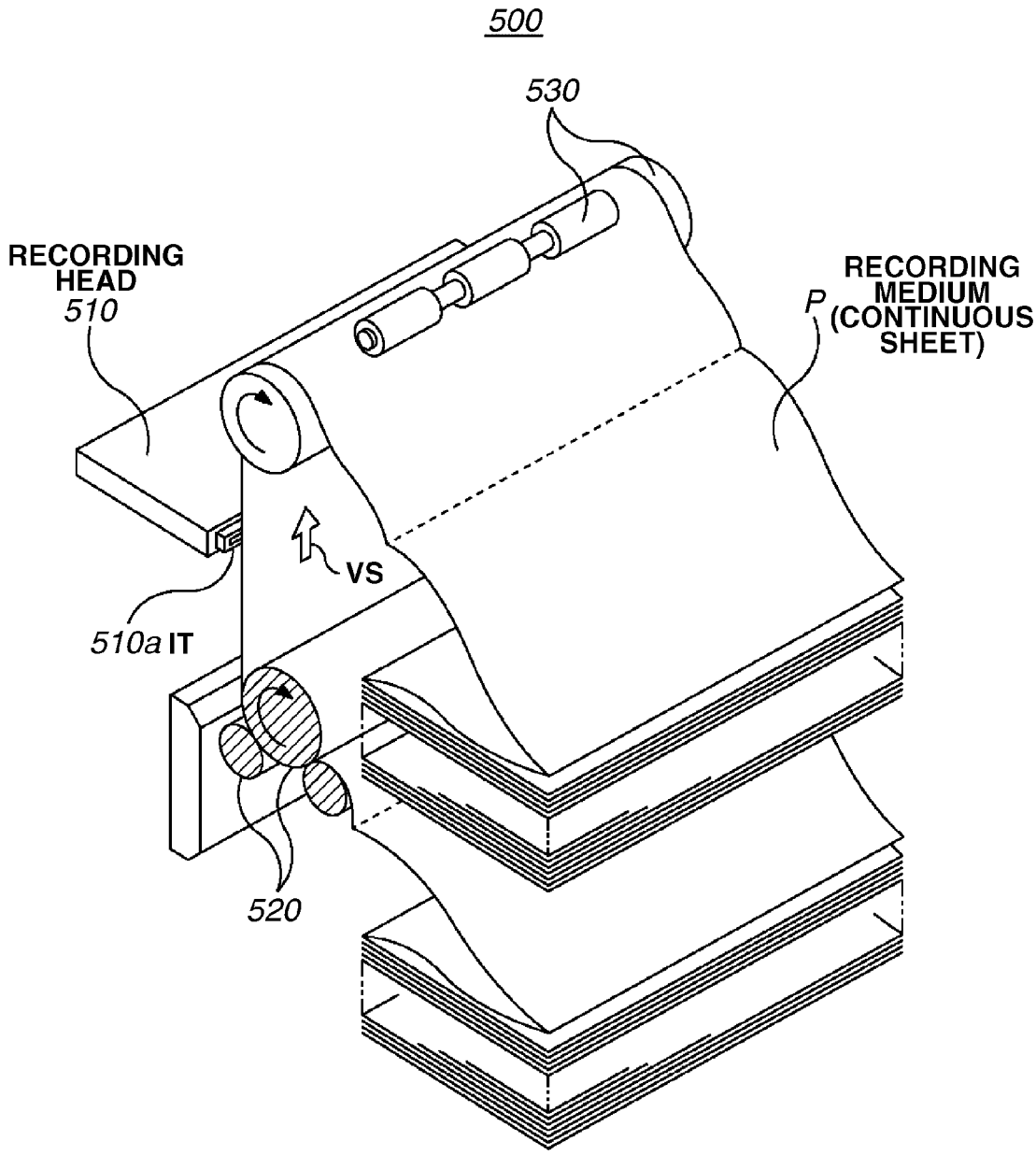
FIG. 5 is a schematic diagram of a printer unit in a recording apparatus according to a first exemplary embodiment of the present invention.

FIG. 5 is a schematic diagram illustrating an example of a configuration of the printer unit in the recording apparatus according to the first exemplary embodiment. More specifically, FIG. 5 illustrates an external perspective view of a main configuration of an inkjet type printer (ink jet recording apparatus—IJRA) as a printer unit 500.

Referring to FIG. 5, the inkjet type printer unit 500 includes a recording head 510, a conveyance roller 520, and a discharge roller 530.

The recording head 510 such as an inkjet recording head (inkjet head—IJH) is a full line type recording head that discharges ink to a range across the entire width of the recoding medium such as a continuous recording medium P. Further, a recording head chip (IT) 510*a* is added to the recording head 510. The ink is discharged at predetermined timing from the discharge port of the recording head chip (IT) 510*a* to the recording medium P such as a recording sheet.

In the present example, a central processing unit (CPU 130 illustrated in FIG. 7) of the recording apparatus to be described below controls driving of a conveyance motor (not illustrated). The recording medium P, i.e., a continuous sheet that can be folded, is thus conveyed in the direction indicated by an arrow VS illustrated in FIG. 5. The recording image is then formed (recorded) on the recording medium P.

The conveyance motor drives the conveyance roller 520 to convey the recording medium P. The discharge roller 530 along with the conveyance roller 520 maintains the recording medium P in a predetermined recording position. The discharge roller 530 also conveys the recording medium P in the direction indicated by the arrow VS in association with the conveyance roller 520 driven by the conveyance motor.

The recording head 510 is connected with an ink supplying tube (not illustrated), and the ink is discharged from the inkjet recording elements (also referred to as nozzles) inside the recording head 510 via the recording head chip 510*a*. As an electricity-heat energy conversion member, a heating element generates heat energy used for discharging ink. The heating element is disposed in an inner portion of the inkjet recording element (i.e., a liquid path) that communicates with the ink discharge port.

The recording apparatus further includes a scanner, such as a scanner 180 illustrated in FIG. 7 to be described below. Using the scanner, the recording apparatus can acquire density data of a test pattern printed by the recording head 510.

When the recording head 510 is not recording the image on the recording medium P, the recording head 510 seals the ink discharge port using a cap portion of a capping unit (not illustrated). The recording head 510 thus prevents firm fixing of the ink due to evaporation of ink solvent and prevents clogging due to adhering of foreign matter such as dust.

The cap portion of the capping unit may be used in an idle discharge (i.e., a preliminary discharge) to solve a discharge defect or clogging of the infrequently-used ink discharge port. In other words, the cap portion can be used to discharge the ink that does not contribute to the recording of the image from the ink discharge portion to the cap portion.

In an ink discharge port in which there is a discharge defect, the ink discharge port can be recovered by applying negative pressure generated by a pump (not illustrated) to inside the cap portion that is covering the ink discharge port. The ink that does not contribute to recording the image is then suctioned and discharged from the ink discharge port of the recording head 510 into the cap unit.

The recording apparatus also may clean a discharge port forming surface of the recording head 510. For example, a blade (i.e., a wiping member, not illustrated) disposed adjacent to the cap portion can clean (wipe) the discharge port forming surface, i.e., the inkjet recording head.

In the example illustrated in FIG. 5, the recording medium P is a continuous sheet. However, the present exemplary embodiment is not limited to such a recording medium and the recording medium P can be cut sheets. Further, in the example illustrated in FIG. 5, the recording head 510 is a single full line type recording head. However, to realize high image recording or high-speed recording of the recording image, there may be two full line type recording heads of the same configuration.

<An Internal Configuration of the Recording Head>

Figure 6:
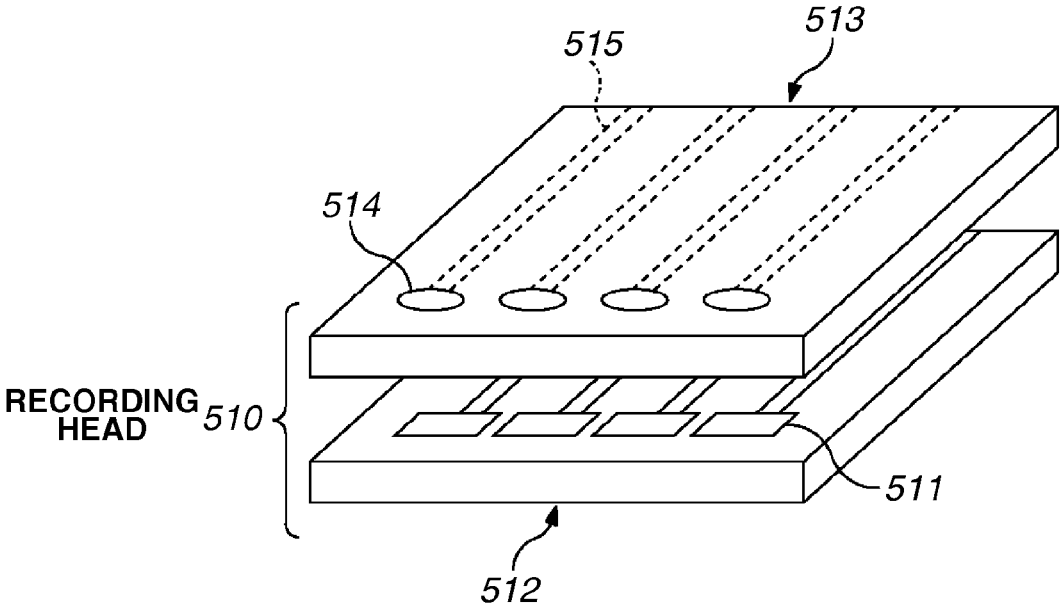
FIG. 6 illustrates an example of an internal configuration of a recording head illustrated in FIG. 5.

FIG. 6 is a schematic diagram illustrating an example of the internal configuration of the recording head 510 illustrated in FIG. 5. More specifically, FIG. 6 illustrates a schematic perspective view of a main internal configuration of the inkjet recording head as the recording head 510.

Referring to FIG. 6, the recording head 510 includes a heater board 512 on which heaters (e.g., more than one heating element) 511 is formed. The recording head 510 also includes a top panel 513 on which discharge ports 514 are formed along with liquid paths 515 that are tunnel-shaped and communicate with each of the discharge ports 514.

The heater (heating element) 511 heats the ink. The heater board 512 is a substrate on which the heaters (heating elements) 511 are formed as described above.

The top panel 513 is placed over the heater board 512. The discharge ports 514 are formed on the top panel 513. The liquid paths 515 are formed in the rear of each of the discharge ports 514. Each of the liquid paths 515 commonly is connected to a single ink liquid chamber in the rear thereof.

Further, the ink is supplied to the ink liquid chamber via an ink supplying port. In turn, the ink is supplied from the ink liquid chamber to each of the liquid paths 515. The discharge ports 514 form discharge ports that can discharge the ink.

The heater board 512 and the top panel 513 are assembled so that the position of each heater 511 corresponds to each liquid path 515 as illustrated in FIG. 6. In the example illustrated in FIG. 6, there are four discharge ports 514, four heaters 511, and four liquid paths 515 representing each of the components, and each heater 511 is arranged corresponding to each liquid path 515.

A predetermined driving pulse is then supplied to the heater 511 in the recording head 510 assembled as illustrated in FIG. 6, so that the ink on the heater 511 boils to form a bubble. A cubical expansion of the bubbles pushes out and discharges the ink from the discharge port 514.

The inkjet recording method to which the present invention is applicable is not limited to a bubble jet (a registered trademark) method, which uses the heating element (heater 511) as illustrated in FIG. 6. The present invention is applicable, for example, to an inkjet method that uses a mechanical pressing force generated by a piezoelectric element to discharge the ink.

For example, a continuous type inkjet method in which ink droplets are continuously discharged and formed into particles includes a charge control type and a dissipation control type. Further, an on-demand type in which ink droplets are discharged as necessary is applicable to a pressure control type in which ink droplets are discharged from an orifice by mechanical vibration of the piezoelectric oscillation element. As described above, the present invention is applicable to the recording head 510 including various types of inkjet recording elements.

<The Configuration of the Recording Apparatus>

Figure 7:
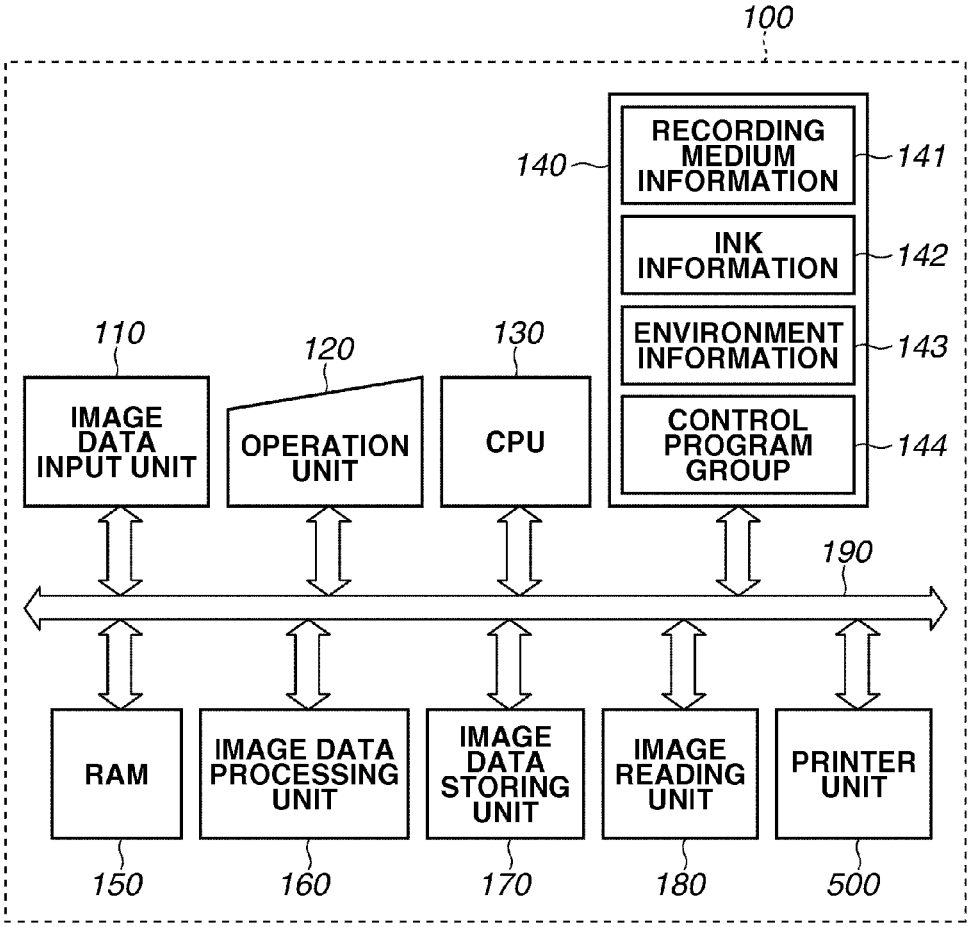
FIG. 7 is a block diagram illustrating a hardware configuration of the recording apparatus according to the first exemplary embodiment of the present invention.

FIG. 7 is a block diagram illustrating an example of a hardware configuration of the recording apparatus according to the first exemplary embodiment of the present invention.

Referring to FIG. 7, a recording apparatus 100 includes an image data input unit 110, an operation unit 120, a CPU 130, and a storage medium 140. The recording apparatus 100 also includes a random access memory (RAM) 150, an image data processing unit 160, an image data storing unit 170, an image reading unit 180, a printer unit 500, and a bus 190.

The image data input unit 110 inputs to the recording apparatus, multivalued image data from an image input apparatus such as a digital camera (not illustrate) or stored in a hard disk of a personal computer.

The operation unit 120 includes various keys for a user to set various parameters and instruct the CPU 130 to start recording the image.

The CPU 130 controls the operation of each internal configuration of the recording apparatus 100 according to various control program groups 144 stored inside the recording medium 140. The CPU 130 thus controls the entire recording apparatus 100.

The storage medium 140 stores recording medium information 141, ink information 142, environment information 143, and the control program group 144. Further, the storage medium 140 stores various tables (not illustrated) as necessary.

The recording medium information 141 refers mainly to information about a type of the recording medium P. The ink information 142 refers to information about the ink used in the recording head of the printer unit 500. Further, the environment information 143 refers to information about the environment, such as temperature and humidity at recording time. The control program group 144 is a group of programs executed when the CPU 130 executes various operations of the recording apparatus 100.

Further, the storage medium 140 may be a read-only memory (ROM), a floppy disk (FP), a compact disk (CD)-ROM, a hard disk (HD), a memory card, or a magneto-optical disk.

The RAM 150 is a work area for executing various control programs and various information processing (including tables) loaded from the storage medium. The RAM 150 also is used as a temporary retreating area when correcting an error, and a work area for performing image processing. Further, various information and tables can be loaded from the storage medium 140 to the RAM 150. The CPU 130 can then change the content of the information and the tables, and performs image processing by referring to the changed information and tables.

The image data processing unit 160 performs various processes on the image data input from the image data input unit 110 and the image reading unit 180, based on the control performed by the CPU 130. For example, the image data processing unit 160 performs color matching, color separation, output γ correction (Greek small letter gamma (γ) correction), and resolution conversion on the multivalued image data input from the image data input unit 110.

The image data processing unit 160 then quantizes the input multivalued data to N-valued image data for each pixel. The image data processing unit 160 selects a dot arrangement pattern corresponding to a gradation value, based on a gradation value "N" indicated by each quantized pixel. According to the present exemplary embodiment, the dot arrangement value is a binary pattern that indicates whether the ink dot is recorded. Selecting the dot arrangement pattern can acquire the binary discharge data.

As described above, the image data processing unit 160 converts the input multivalued image data to the N-valued image data, and creates the binary discharge data based on the N-valued image data. For example, if the multivalued image data expressed by 8 bits (256 gradations) is input to the image data input unit 110, the image data processing unit 160 quantizes the gradation value of the output image data to 25 values.

The image data processing unit 160 then assigns the dot arrangement pattern to the 25-valued image data, and creates the binary discharge data indicating discharge/non-discharge of the ink. The image data processing unit 160 distributes the binary discharge data to the discharge port arrays, and determines the binary discharge data corresponding to the discharge port of each discharge port array.

According to the present exemplary embodiment, a multivalued error diffusion method is employed in N-valued processing of the input gradation image data. However, the present invention is not limited to the above, and, for example, any halftone processing method such as an average density preserving method or a dither matrix method may be performed.

Further, since it is only necessary for the image data processing unit 160 to create the binary discharge data from the multivalued image data, it is not necessary to additionally perform N-valued processing as described above. For example, the image data processing unit 160 can perform binary processing to convert the input multivalued image data directly into the binary discharge data.

The image data storing unit 170 stores the image data input from the image data input unit 110 and the image reading unit 180, and the image data processed by the image data processing unit 160.

The image reading unit 180, such as a scanner, is controlled by the CPU 130 to read the test pattern printed by the recording head 510, and acquires the density data thereof.

The printer unit 500 corresponds to the printer unit 500 illustrated in FIG. 5. The CPU 130 controls the printer unit 500 to discharge ink from the corresponding discharge port 514 according to the binary discharge data created by the image data processing unit 160. The printer unit 500 thus forms a dot image (recording image) on the recording medium P.

The bus 190 mutually connects each of the components included in the recording apparatus 100 illustrated in FIG. 7, to be communicable with each other.

<A Schematic Configuration of the Recording Head>

Figure 8:
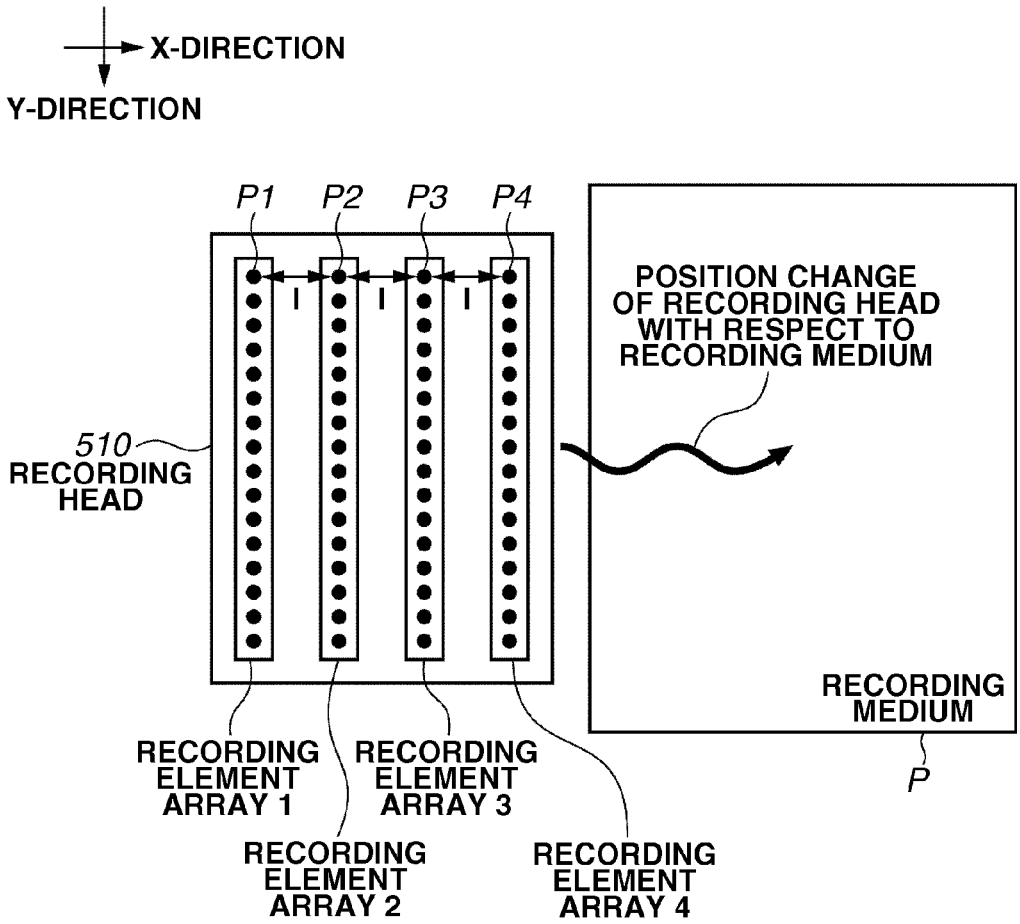
FIG. 8 illustrates an example of a schematic configuration of the recording head illustrated in FIG. 5 according to the first exemplary embodiment of the present invention.

FIG. 8 is a schematic diagram illustrating an example of a configuration of the recording head 510 illustrated in FIG. 5 according to the first exemplary embodiment. The multiple array head is applied as the recording head 510 illustrated in FIG. 5 in the example illustrated in FIG. 8.

Referring to FIG. 8, the recording head 510 includes four recording element arrays disposed at an interval of length l (small letter el). Multiple recording elements that discharge ink (recording material) of the same color (type) at a resolution of 1200 dpi are aligned in each recording element array. Any recording head in which three or more recording element arrays are disposed in parallel may be applied to the recording head 510 according to the present exemplary embodiment.

Further, the recording apparatus 100 according to the present exemplary embodiment forms (records) the recording image on the recording medium P by relatively moving the recording head 510 with respect to the recording medium P in a direction perpendicular to the direction in which the recording element arrays are arranged.

<Recording Method>

Figure 9:
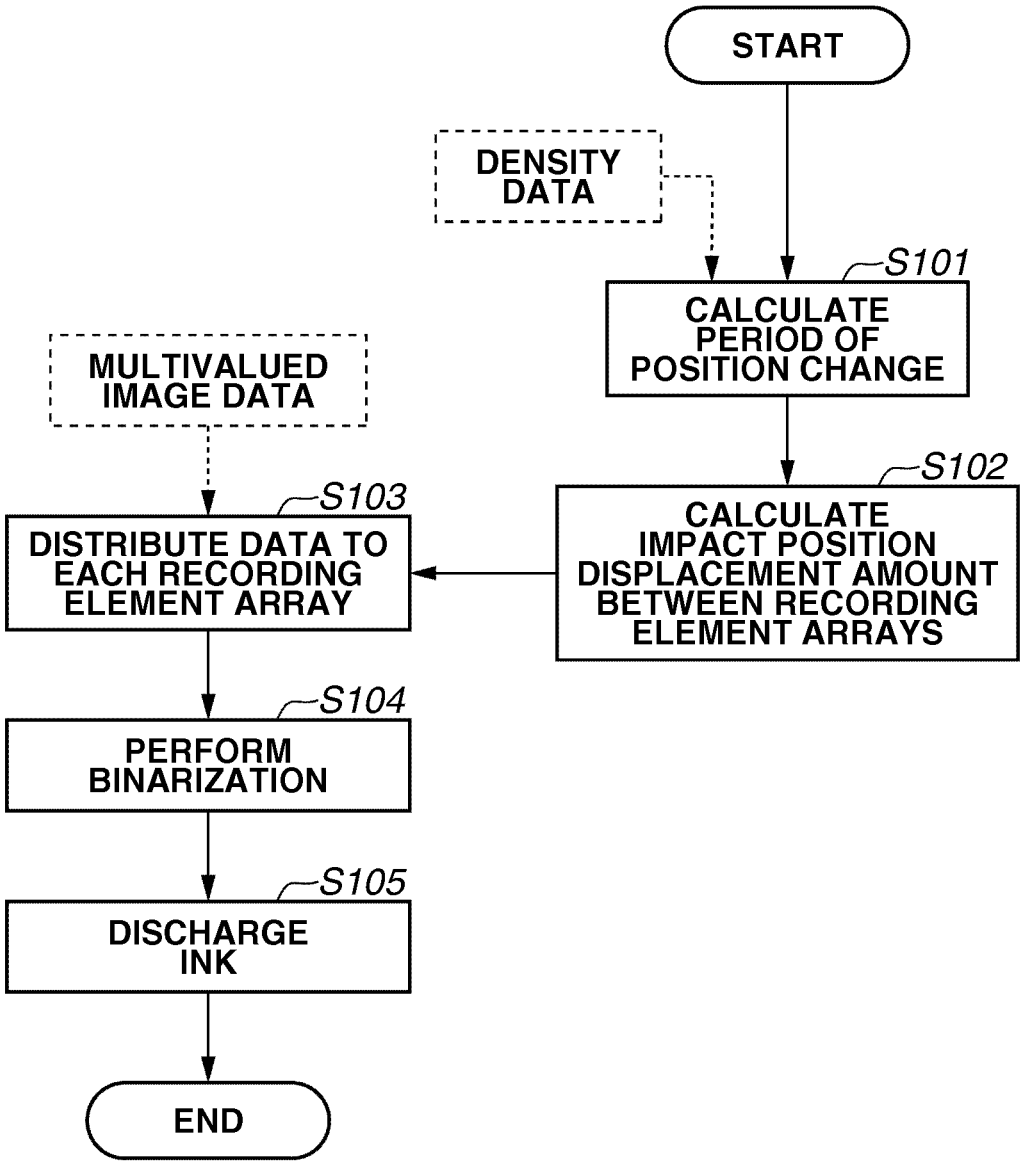
FIG. 9 is a flowchart illustrating an example of a recording process of the recording apparatus according to the first exemplary embodiment of the present invention.

FIG. 9 is a flowchart illustrating an example of a recording process performed by the recording apparatus according to the first exemplary embodiment. The process is performed for determining the recording data (binary data) to be used by each recording element in the recording head 510 to discharge the ink dots, and record the recording image on the recording medium P. The image data processing unit 160 and the printer unit 500 perform the process illustrated in the flowchart of FIG. 9 based on control performed by the CPU 130.

The operation modes of the recording apparatus 100 according to the present exemplary embodiment will be described below. There are two operation modes of the recording apparatus 100, i.e., a print mode (recording mode) and a calibration mode. The print mode is for recording the recording image on the recording medium P. The calibration mode is for adjusting the recording rate of each recording element array with respect to the recording medium P to the most appropriate state.

The process performed by the recording apparatus 100 in the calibration mode will be described below.

In the calibration mode, the CPU 130 controls the printer unit 500 to print the test pattern of uniform gradation, using two of the four recording element arrays 1, 2, 3, and 4. The CPU 130 then controls the image reading unit 180, e.g., the scanner, to acquire the density data of the printed test pattern.

According to the present exemplary embodiment, only two of the four recording element arrays are used to print the test pattern. As a result, if the position of the recording head 510 periodically changes with respect to the recording medium, the period of the position change becomes the same as the period in which the density change is repeatedly generated in the direction perpendicular to the recording element array.

In step S101 illustrated in FIG. 9, the image data processing unit 160 thus uses the above-described characteristic, and calculates the period of the position change of the recording head 510 with respect to the recording medium. The image data processing unit 160 calculates the period of the position change using the density data acquired by the image reading unit 180.

In step S102, the image data processing unit 160 calculates amounts of displacement between the impact positions of the ink dots of the recording element arrays. The image data processing unit 160 calculates using the period of the position change of the recording head 510 with respect to the recording medium calculated in step S101. The image data processing unit 160 then sets the recording rate of each of the recording element arrays with respect to the recording medium to be used in step S103.

The process performed in step S102 will be described in detail below. The image data processing unit 160 creates a profile of the displacement information indicating the relative impact positions of the ink dots discharged from each of the recording elements on the recording medium. The positions of the recording elements in the X-direction of the recording element array are the same.

Figure 10:
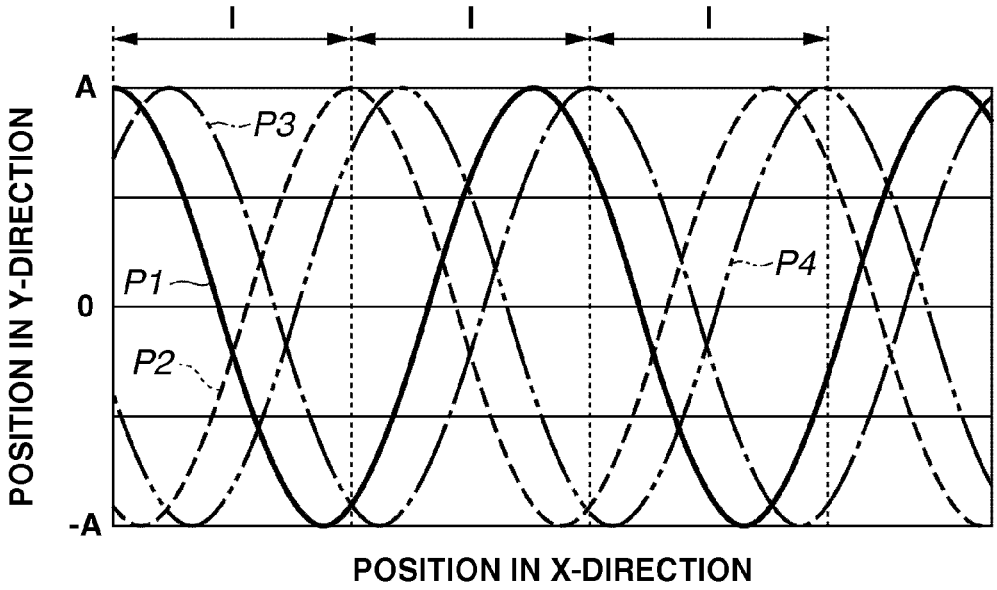
FIG. 10 illustrates an example of relative impact positions of ink dots discharged from each recording element of a recording head.
Figure 11:
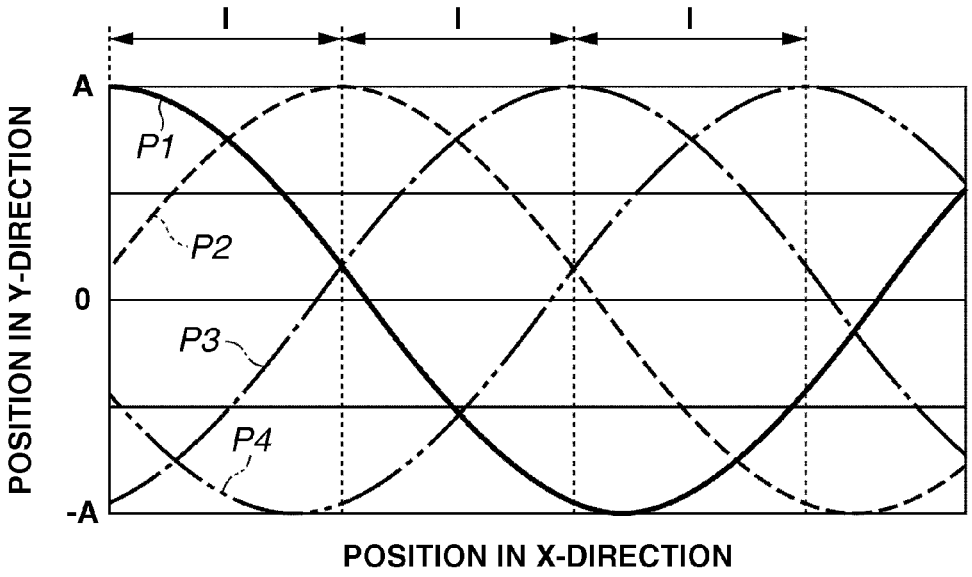
FIG. 11 illustrates an example of relative impact positions of ink dots discharged from each recording element of a recording head.

FIG. 10 and FIG. 11 illustrate examples of the relative impact positions of the ink dots discharged from each of the recording elements in the recording head 510. More specifically, according to the present exemplary embodiment, FIG. 10 and FIG. 11 illustrate examples of the relative impact positions of the ink dots discharged from the recording elements P1, P2, P3, and P4 illustrated in FIG. 8. The difference between FIG. 10 and FIG. 11 is the period of the position change of the recording head 510 with respect to the recording medium. In both FIG. 10 and FIG. 11, sine waves of equal amplitudes express the impact positions of the ink dots discharged from each of the recording element arrays.

The periods of the sine waves illustrated in FIG. 10 and FIG. 11 correspond to the periods of the position change of the recording head 510 with respect to the recording medium calculated in step S101. Further, there is phase shifting of a distance l (small letter el) between the impact positions of the ink dots discharged from the recording element arrays that change in the sine-wave form illustrated in FIG. 10 and FIG. 11. The distance l is the distance between the recording element arrays. According to the present exemplary embodiment, the impact positions of the ink dots of the recording element arrays are expressed as sine waves for ease of description. However, functions other than the sine wave may express the impact positions of the ink dots.

The image data processing unit 160 then calculates the amount of displacement between the impact positions of the recording element arrays in step S102. The image data processing unit 160 calculates using the profile indicating the relative impact positions of the ink dots discharged from each recording element array on the recording medium. More specifically, the image processing unit 160 acquires the distances between the impact positions of the ink dots discharged from each of the recording element arrays and the impact positions of the ink dots discharged from the recording element array to which a maximum recording rate is set.

The information about the recording element array to which the maximum recording rate is to be set is previously stored and set in the storage medium 140 as the reference recording element array. According to the present exemplary embodiment, the maximum recording rate of the ink with respect to the recording medium is set to the recording element array 1.

Figure 12:
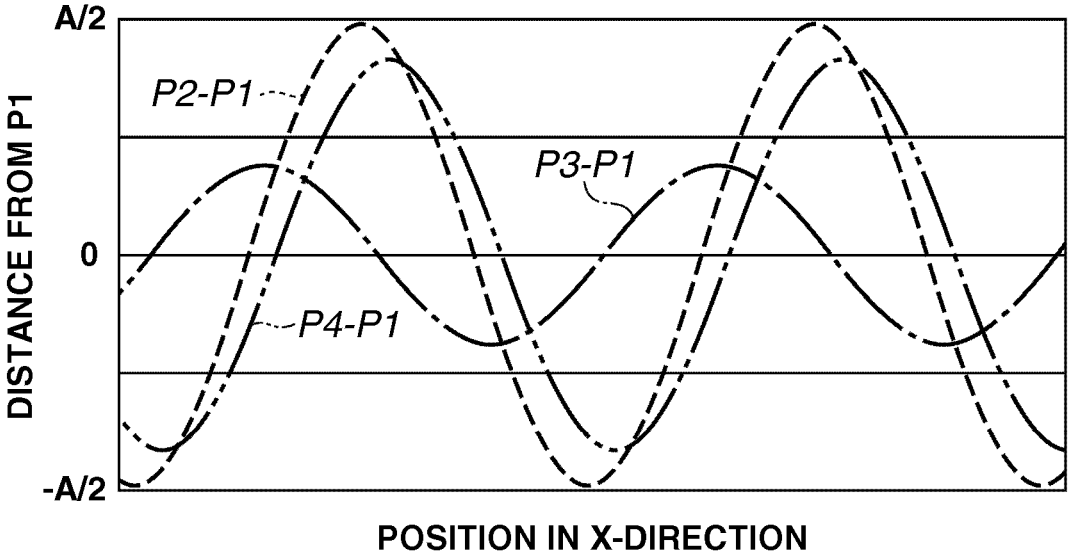
FIG. 12 illustrates an example of a distance between an impact position of an ink dot discharged from a recording element P1 of the recording head and impact positions of ink dots discharged by each of recording elements P2, P3, and P4 according to a case illustrated in FIG. 10.
Figure 13:
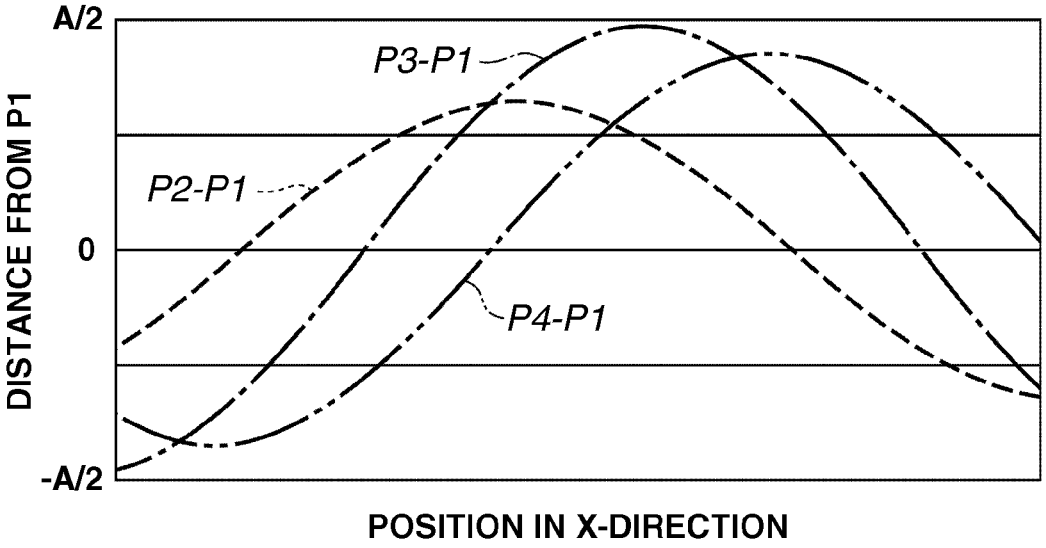
FIG. 13 illustrates an example of a distance between an impact position of an ink dot discharged from a recording element P1 of the recording head and impact positions of ink dots discharged by each of recording elements P2, P3, and P4 according to a case illustrated in FIG. 11.

FIG. 12 illustrates an example of the distances between the impact positions of the ink dots discharged from the recording element P1 of the recording head 510 and the impact positions of the ink dots discharged from each of the recording elements P2, P3, and P4. The distances illustrated in FIG. 12 are based on the impact positions illustrated in FIG. 10. Further, FIG. 13 illustrates an example of the distances between the impact position of the ink dot discharged from the recording element P1 of the recording head 510 and the impact positions of the ink dots discharged by each of the recording elements P2, P3, and P4. The distances illustrated in FIG. 13 are based on the impact positions illustrated in FIG. 11.

The image data processing unit 160 then sets the recording rate of each of the recording element arrays with respect to the recording medium to be used in step S103. The image data processing unit 160 sets the recording rates based on maximum values of the amounts of displacement between the impact positions of the recording element arrays. In the case illustrated in FIG. 12, the sizes of the maximum values of the amounts of displacement between the impact positions of the ink dots of the recording element array 1, and each recording element array are in an increasing order from the recording element array 3, the recording element array 4, to the recording element array 2.

The image data processing unit 160 thus sets the size of the recording rates of the recording element arrays other than the recording element array 1 to be in a decreasing order from the recording element array 3, the recording element array 4, to the recording element array 2. The maximum recording rate is set to the recording element array 1. More specifically, the image data processing unit 160 sets the recording rate of each of the recording element arrays with respect to the recording medium as illustrated in FIG. 14.

Referring to FIG. 14, according to the present exemplary embodiment, the second largest recording rate is set to the recording element array 3, whose maximum amount of the ink dot impact position displacement amount with respect to the recording element array 1 is the smallest.

Further, according to the present exemplary embodiment, the smallest recording rate is set to the recording element array 2, whose maximum amount of the ink dot impact position displacement amount with respect to the recording element array 1 is the largest, as illustrated in FIG. 14. Furthermore, according to the present exemplary embodiment, a larger recording rate is set to the recording element array whose maximum amount of the ink dot impact position displacement amount with respect to the recording element array 1 is smaller, as illustrated in FIG. 14.

FIG. 14 illustrates an example of a table for setting the recording rates with respect to the recording medium of each of the recording element arrays illustrated in FIG. 12.

On the other hand, the period of the position change of the recording head 510 with respect to the recording medium is longer in FIG. 13 as compared to FIG. 12. In the example illustrated in FIG. 13, the size of the maximum values of the amounts of displacement between the impact position of the ink dots of the recording element array 1 and each recording element array are in an increasing order from the recording element array 2, the recording element array 4, to the recording element array 3.

In such a case, the image data processing unit 160 sets the size of the recording rates of the recording element arrays other than the recording element array 1 to be in a decreasing order from the recording element array 2, the recording element array 4, to the recording element array 3. The maximum recording rate is set to the recording element array 1. More specifically, the image data processing unit 160 sets the recording rate of each of the recording element arrays with respect to the recording medium as illustrated in FIG. 15.

Referring to FIG. 15, according to the present exemplary embodiment, the second largest recording rate, next to the recording element array 1 to which the largest recording rate is set, is set to the recording element array 2, whose maximum amount of the ink dot impact position displacement amount with respect to the recording element array 1 is the smallest, as illustrated in FIG. 15.

Further, according to the present exemplary embodiment, the smallest recording rate is set to the recording element array 3, whose maximum amount of the ink dot impact position displacement amount with respect to the recording element array 1 is the largest as compared to the recording element array 1, as illustrated in FIG. 15. Furthermore, according to the present exemplary embodiment, a larger recording rate is set to the recording element array whose maximum amount of the ink dot impact position displacement amount with respect to the recording element array 1 is smaller as compared to the recording element array 1, as illustrated in FIG. 15.

FIG. 15 illustrates an example of a table for setting the recording rates with respect to the recording medium of each of the recording element arrays illustrated in FIG. 13.

The total sum of the recording rate of each of the recording element arrays is 100% in the setting tables illustrated in FIG. 14 and FIG. 15. However, the recording rate of each of the recording element arrays may be set so that the total sum does not become 100%.

Further, the recording rate of each of the recording element arrays is set by distributing to the recording element arrays, effects of the impact displacement of the ink dots, or dispersion of the dot diameters. Determining the image quality sets the recording rate so that the image quality deterioration due to such effects can be reduced. Further, the setting tables illustrated in FIG. 14 and FIG. 15 are stored in the storage medium 140.

The process performed by the recording apparatus 100 in the print mode (recording mode) will be described below with reference to FIG. 9.

In step S103, the image data processing apparatus 160 distributes the multivalued image data input from the image data input unit 110 to the recording element arrays, based on the recording rates of the recording element arrays set in step S102. More specifically, the image data processing unit 160 distributes the multivalued image data based on a distribution rate acquired by multiplying the recording rate of each recording element arrays to each pixel value of the multivalued image data respectively.

For example, if the recording rates illustrated in FIG. 14 are set to the recording element arrays, the recording rate of the recording element array 1 is 40%. Multiplying 0.4 to each pixel value in the input multivalued image data acquires data of the ink dots to be recorded by the recording element array 1 on the recording medium.

In step S104, the image data processing unit 160 binarizes each of the multivalued image data distributed to the recording element arrays in step S103 using, for example, an error dispersion method to represent them in binary. According to the present exemplary embodiment, methods other than the error dispersion method may be used to binarize the multivalued image data.

In step S105, the printer unit 500 discharges ink from each recording element of each recording element array in the recording head 510 to the recording medium P, according to the binarized data acquired in step S104. The process of the flowchart illustrated in FIG. 9 then ends.

The process illustrated in FIG. 9 distributes the multivalued image data to the recording element arrays (in step S103) and then binarizes the multivalued image data (in step S104). However, the present exemplary embodiment is not limited to the above, and, for example, the order of performing each of the processes may be reversed.

Figure 16:
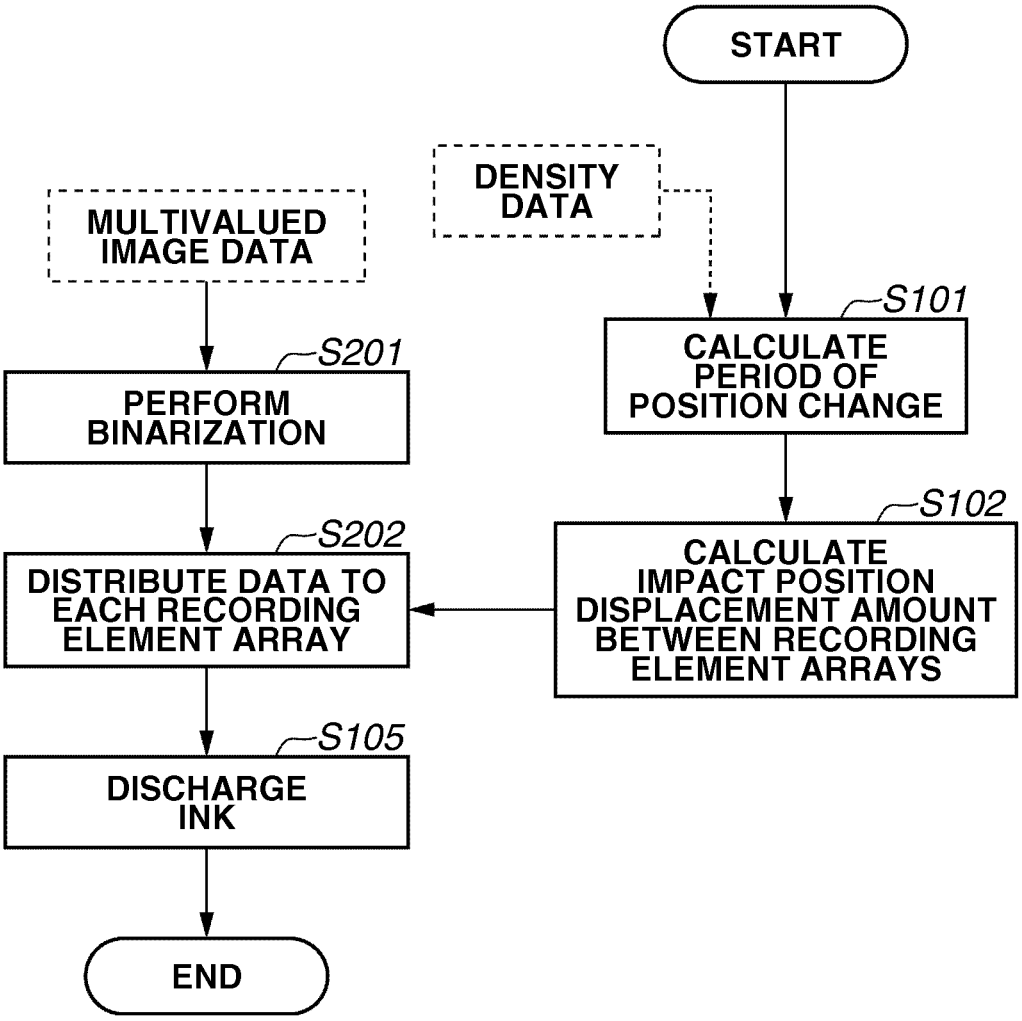
FIG. 16 is a flowchart illustrating another example of a recording process of the recording apparatus according to the first exemplary embodiment of the present invention.

FIG. 16 is a flowchart illustrating another example of the recording method performed by the recording apparatus according to the first exemplary embodiment. The same reference numbers are assigned to steps illustrated in FIG. 16 that perform similar processes as the steps illustrated in FIG. 9, and detailed description is thus omitted.

Step S101 and step S102 in the flowchart illustrated in FIG. 16 are the same as those in the flowchart illustrated in FIG. 9. In step S201, the image data processing unit 160 binarizes the multivalued image data input from the image data input unit 110 using a similar method as illustrated in step S201 in FIG. 9.

In step S202, the image data processing unit 160 distributes, using a mask for example, the binarized data acquired in step S201 to the recording element arrays based on the recording rates of the recording element arrays set in step S102.

The process performed in step S105 illustrated in FIG. 9 is then performed, and the process of the flowchart illustrated in FIG. 16 ends.

According to the first exemplary embodiment, when forming the recording image on the recording medium, the periodical density change generated due to the periodical position change of the recording head with respect to the recording medium can be reduced. In particular, according to the first exemplary embodiment, the multiple array head is used as the recording head to reduce image deterioration due to combining of the ink droplets. Further, the periodical density unevenness is reduced to acquire high-quality recording image.

A second exemplary embodiment according to the present invention will be described below with reference to the drawings. The difference from the first exemplary embodiment will be mainly described.

According to the first exemplary embodiment, the multiple array head illustrated in FIG. 8 is employed as the recording head 510. According to the second exemplary embodiment, the joint head is used as the recording head 510. The hardware configuration of the recording apparatus according to the second exemplary embodiment is similar to the hardware configuration of the recording apparatus according to the first exemplary embodiment illustrated in FIG. 7.

Figure 17:
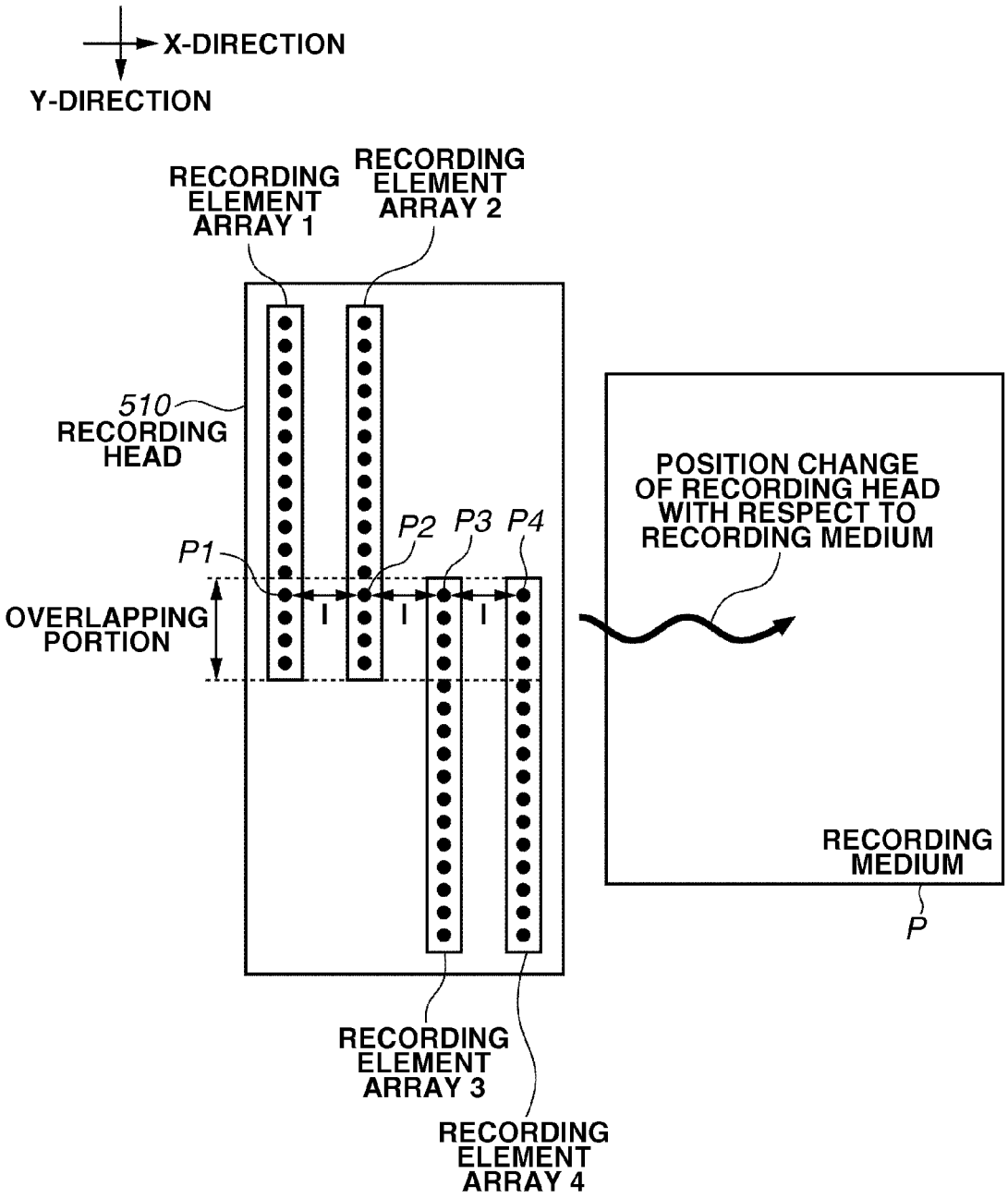
FIG. 17 illustrates an example of a schematic configuration of the recording head illustrated in FIG. 5 according to a second exemplary embodiment of the present invention.

FIG. 17 is a schematic diagram illustrating an example of the configuration of the recording head 510 illustrated in FIG. 5 according to the second exemplary embodiment. Referring to FIG. 17, the joint head is applied to the recording head 510 illustrated in FIG. 5.

The recording head 510 illustrated in FIG. 17 is configured of recording element arrays, each of which include recording elements that discharge the same color (type) ink (recording material) at a resolution of 1200 dpi. More specifically, the recording element arrays overlap in one joint portion of the recording head 510 illustrated in FIG. 17. There are four recording element arrays arranged at an interval of the length l (small letter el).

According to the present exemplary embodiment, any recording head in which three or more recording element arrays are arranged may be applied to the recording head 510. Further, the recording apparatus 100 according to the present exemplary embodiment forms (records) the recording image on the recording medium P by relatively moving the recording head 510 with respect to the recording medium P in a direction perpendicular to the direction in which the recording element arrays are arranged.

<Recording Method>

The recording method according to the first exemplary embodiment illustrated in FIG. 9 may be employed as the recording method of the recording apparatus 100 according to the present exemplary embodiment. The recording apparatus 100 determines the recording data (binary data) of the ink dots from each of the recording elements in the overlapping portion of the recording head 510 illustrated in FIG. 17 by performing the process illustrated in FIG. 9. The recording apparatus 100 thus records the recording image on the recording medium P. The image data processing unit 160 and the printer unit 500 perform the process illustrated in the flowchart of FIG. 9 based on the control performed by the CPU 130.

Before describing the flowchart in FIG. 9, the process performed by the recording apparatus 100 in the calibration mode will be described below.

Calibration includes checking/adjusting accuracy of a measuring instrument, such as by comparison with a standard. In the calibration mode, the CPU 130 controls the printer unit 500 to print the test pattern of uniform gradation, using two of the four recording element arrays 1, 2, 3, and 4 that form the overlapping portion. The image reading unit 180 such as the scanner then acquires the density data of the printed test pattern, based on the control performed by the CPU 130.

According to the present exemplary embodiment, only two of the recording element arrays are used to print the test pattern. As a result, if the position of the recording head 510 with respect to the recording medium changes periodically, the period of the position change becomes the same as the period in which the density change is repeatedly generated in the overlapping portion in the direction perpendicular to the recording element array.

In step S101 illustrated in FIG. 9, the image data processing unit 160 thus uses the above-described characteristic and calculates the period of the position change of the recording head 510 with respect to the recording medium. The image data processing unit 160 calculates using the density data acquired by the image reading unit 180.

In step S102, the image data processing unit 160 calculates the amounts of displacement between the impact positions of the ink dots of the recording element arrays in the overlapping portion. The image data processing unit 160 calculates using the period of the position change of the recording head 510 with respect to the recording medium calculated in step S101. The image data processing unit 160 then sets the recording rate with respect to the recording medium of each of the recording element arrays in the overlapping portion to be used in step S103.

The process performed in step S102 will be described in detail below. The image data processing unit 160 creates the profile of the displacement information indicating the relative impact positions, on the recording medium, of the ink dots discharged from each of the recording elements in the overlapping portion. The positions of the recording elements in the overlapping portion in the X-direction of the recording element array are the same.

The process performed in step S102 will be described in detail below with reference to the above-described FIGS. 10, 11, 12, 13, 14, and 15.

FIG. 10 and FIG. 11 illustrate examples of the relative impact positions of the ink dots discharged from each of the recording elements in the recording head 510. More specifically, according to the present exemplary embodiment, FIG. 10 and FIG. 11 illustrate examples of the relative impact positions of the ink dots discharged from the recording elements P1, P2, P3, and P4 illustrated in FIG. 17. The difference between FIG. 10 and FIG. 11 is the period of the position change of the recording head 510 with respect to the recording medium. In both FIG. 10 and FIG. 11, sine waves of equal amplitudes express the impact positions of the ink dots discharged from each of the recording elements.

The periods of the sine waves illustrated in FIG. 10 and FIG. 11 correspond to the periods of the position change of the recording head 510 with respect to the recording medium calculated in step S101. Further, there is phase shifting by the distance 1 between the impact positions of the ink dots discharged from the recording element arrays that change in the sine-wave form illustrated in FIG. 10 and FIG. 11. The distance 1 is the distance between the recording element arrays. According to the preset exemplary embodiment, the impact positions of the ink dots of the recording element arrays are expressed as sine waves for ease of description. However, functions other than the sine wave also may express the impact positions of the ink dots.

The image data processing unit 160 then calculates the amount of displacement between the impact positions of the recording element arrays in step S102. The image data processing unit 160 calculates using the profile indicating the relative impact positions on the recording medium of the ink dots discharged from each recording element array. More specifically, the image processing unit 160 acquires with respect to the overlapping position illustrated in FIG. 17, each of the distances between the impact positions of the ink dots discharged from each of the recording element arrays, and from the recording element array to which the maximum recording rate is set.

The information about the recording element array to which the maximum recording rate is to be set at the overlapping portion thereof is previously stored and set in the storage medium 140 as the reference recording element array. According to the present exemplary embodiment, the maximum recording rate of the ink with respect to the recording medium in the overlapping portion is set to the recording element array 1.

FIG. 12 and FIG. 13 illustrate examples of the distances between the impact positions of the ink dots discharged from the recording element P1 and to each of the recording elements P2, P3, and P4 in the recording head 510. FIG. 12 and FIG. 13 illustrate the examples of the distances based on the impact positions illustrated in FIG. 10 and FIG. 11.

The image data processing unit 160 then sets the recording rate of each of the recording element arrays with respect to the recording medium in the overlapping portion to be used in step S103. The image data processing unit 160 sets the recording rates based on the maximum values of the impact position displacement amounts between the recording element arrays. More specifically, in the case illustrated in FIG. 12, the sizes of the maximum values of the amounts of displacement between the impact positions of the ink dots of the recording element array 1 and each recording element array are in an increasing order from the recording element array 3, the recording element array 4, to the recording element array 2.

The image data processing unit 160 then sets the size of the recording rates of the recording element arrays in the overlapping portion other than the recording element array 1 to be in a decreasing order from the recording element array 3, the recording element array 4, to the recording element array 2. The maximum recording rate in the overlapping portion is set to the recording element array 1. The image data processing unit 160 thus sets the recording rate of each of the recording element arrays with respect to the recording medium in the overlapping portion as illustrated in FIG. 14.

In other words, according to the present exemplary embodiment, the second largest recording rate in the overlapping portion is set to the recording element array 3, whose maximum value of the ink dot impact position displacement amount with respect to the recording element array 1, which has the largest recording rate, is the smallest, as illustrated in FIG. 14.

Further, according to the present exemplary embodiment, the smallest recording rate is set to the recording element array 2, whose maximum amount of the ink dot impact position displacement amount with respect to the recording element array 1 is the largest, as illustrated in FIG. 14. Furthermore, according to the present exemplary embodiment, a larger recording rate is set to the recording element array whose maximum amount of the ink dot impact position displacement amount with respect to the recording element array 1 is smaller, as illustrated in FIG. 14.

On the other hand, the period of the position change of the recording head 510 with respect to the recording medium is longer in FIG. 13 as compared to that in FIG. 12. In the example illustrated in FIG. 13, the maximum values of the amounts of displacement between the impact position of the ink dots of the recording element array 1 and each recording element array are in an increasing order from the recording element array 2, the recording element array 4, to the recording element array 3.

In such a case, the image data processing unit 160 sets the size of the recording rates of the recording element arrays in the overlapping portion other than the recording element array 1 to be in a decreasing order from the recording element array 2, the recording element array 4, to the recording element array 3. The maximum recording rate is set to the recording element array 1. More specifically, the image data processing unit 160 sets the recording rate of each of the recording element arrays with respect to the recording medium in the overlapping portion as illustrated in FIG. 15.

According to the present exemplary embodiment, the second largest recording rate in the overlapping portion is thus set to the recording element array 2, whose maximum amount of the ink dot impact position displacement amount with respect to the recording element array 1 is the smallest, as illustrated in FIG. 15. The maximum recording rate with respect to the recording medium in the overlapping portion is set to the recording element array 1.

Further, according to the present exemplary embodiment, the smallest recording rate is set to the recording element array 3, whose maximum amount of the ink dot impact position displacement amount with respect to the recording element array 1 is the largest, as illustrated in FIG. 15. Furthermore, according to the present exemplary embodiment, a larger recording rate is set to the recording element array whose maximum amount of the ink dot impact position displacement amount with respect to the recording element array 1 is smaller, as illustrated in FIG. 15.

The total sum of the recording rate of each of the recording element arrays in the overlapping portion is 100% in the setting tables illustrated in FIG. 14 and FIG. 15. However, the recording rate of each of the recording element arrays in the overlapping portion may be set so that the total sum does not become 100%.

Further, the recording rate of each of the recording element arrays in the overlapping portion are set by distributing the effects of the impact displacement of the ink dots or dispersion of the dot diameters to the recording element arrays. The recording rate is set by determining the image quality so that the image quality deterioration due to such effect can be reduced. Further, the setting tables illustrated in FIG. 14 and FIG. 15 are stored in the storage medium 140.

The process performed by the recording apparatus 100 in the print mode (recording mode) will be described below with reference to FIG. 9.

In step S103, the image data processing apparatus 160 distributes the multivalued image data to be used in recording in the overlapping portion, based on the recording rates of the recording element arrays in the overlapping portion set in step S102.

More specifically, the image data processing unit 160 distributes the multivalued image data by multiplying the recording rate of each recording element array in the overlapping portion to each pixel value of the multivalued image data to be used in recording in the overlapping portion respectively. For example, the recording rate of the recording element array 1 in the overlapping portion is 40%. The data to be used by the recording element array 1 for recording in the overlapping portion is thus created by multiplying 0.4 to each pixel value in the input multivalued image data to be used for recording in the overlapping portion.

If the recording rates illustrated in FIG. 14 are set, the recording rate of the recording element array 1 in the overlapping portion is 40%. Data of the ink dots, which the recording element array 1 is to record on the recording medium in the overlapping portion, is thus created by multiplying 0.4 to each pixel value in the input multivalued image data.

Further, according to the present exemplary embodiment, the recording rate of all recording element arrays in the non-overlapping portion is 50%. As a result, multiplying 0.5 to each pixel value in the multivalued image data creates the data of the ink dots to be recorded on the recording medium by the recording element array 1 in the non-overlapping portion.

Furthermore, according to the present exemplary embodiment, the total sum of the recording rates of the recording element arrays in the non-overlapping portion is set to 100%. However, the present invention is not limited to the above, and the recording rates may be set so that the total sum of the recording rates of the recording element arrays in the non-overlapping portion does not become to 100%.

Moreover, the recording rate of each of the recording element arrays in the overlapping portion is set by distributing the effects of the impact displacement of the ink dots or dispersion of the dot diameters to the recording element arrays. The recording rate is set by determining the image quality so that the image quality deterioration due to such effects can be reduced.

In step S104, the image data processing unit 160 binarizes each of the multivalued image data distributed to the recording element arrays in step S103 using, for example, the error dispersion method. According to the present exemplary embodiment, methods other than the error dispersion method may be used to binarize the multivalued image data.

In step S105, the printer unit 500 discharges ink from each recording element of each recording element array in the recording head 510 to the recording medium P, according to the binarized data acquired in step S104. The process of the flowchart illustrated in FIG. 9 then ends.

The process illustrated in FIG. 9 distributes the multivalued image data to the recording element arrays in step S103, and then binarizes the multivalued image data in step S104. However, the present exemplary embodiment is not limited to the above, and, for example, the order of performing each of the processes may be reversed as illustrated in FIG. 16. The binary data can be distributed to each recording element array by performing masking after binarization, so that the recording rate of each recording element array becomes the desired value.

According to the second exemplary embodiment, when forming the recording image on the recording medium, the periodical density change caused by the periodical position change of the recording head with respect to the recording medium can be reduced. This is similar to the first exemplary embodiment. In particular, according to the second exemplary embodiment, the joint head is used as the recording head to realize high-speed recording. Further, the line that is periodically generated at the joint portion is reduced to acquire high-quality recording image.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

According to the above-described exemplary embodiments, the full line type inkjet recording apparatus is applied to the recording apparatus 100. However, the present invention is not limited to such an embodiment. For example, the serial type inkjet recording apparatus, which discharges the recording medium while scanning a carriage in the main-scanning direction may be applied to the recording apparatus 100.

The serial type inkjet recording apparatus records the recording image on the recording medium using the serial type recording head that moves along the recording medium. In other words, the recording apparatus records on the entire recording medium by repeating the operation of conveying the recording medium by a predetermined amount when the recording head performs recording in one main-scanning portion.

Further, according to the above-described exemplary embodiments, the period of the position change of the recording head 510 with respect to the recording medium is calculated based on the density data of the test pattern acquired by the image reading unit 180 such as the scanner. However, the period of the position change may be calculated using other methods. For example, a user may visually evaluate printed test patterns, and the evaluation result is used in calculating the period of the position change of the recording head 510 with respect to the recording medium.

Furthermore, the present invention can be embodied as a system, an apparatus, a method, a program, or a storage medium. More specifically, the present invention is applicable to a system including multiple devices (e.g., a host computer, an interface device, a reader, and a printer), to an apparatus including a single device (e.g., a copying machine or a facsimile).

Moreover, the present invention is not limited to a case where the image data processing unit 160 performs image data processing in the recording apparatus. The image data processing may be performed in an external apparatus (i.e., a computer), which controls the recording apparatus.

In such a case, the external apparatus determines the binary data for each discharge port array, and transfers the binary data to the recording apparatus. The recording apparatus then records the recording image on the recording medium according to the transferred data. The external apparatus also configures the recording apparatus according to the present invention.

Further, the CPU (130) of the computer executing a control program stored in the storage medium (140) realizes the steps illustrated in FIG. 9 and FIG. 16 that illustrate the recording method of the recording apparatus 100 according to the above-described exemplary embodiments. The control program and a computer-readable storage medium that stores the control program constitute the present invention. A computer-readable medium having stored thereon, the control program may cause an information processing apparatus to perform a method according to the present invention.

Software programs (i.e., the programs corresponding to the flowcharts illustrated in FIG. 9 and FIG. 16 according to the exemplary embodiments) for realizing the functions of the above-described exemplary embodiments are directly or remotely supplied to the system or the apparatus according to the present invention. The software (program code) can be read and executed by a computer of the system or the apparatus.

The present invention also can be achieved by providing software (program code) via a network or various types of storage media for implementing functions of the above-described exemplary embodiments, to a system or an apparatus. A computer (central processing unit (CPU) or micro-processing unit (MPU)) of the system or the apparatus can read and execute the program code stored in the storage medium.

In the specification, "recording" is not limited to formation of significant information such as characters and graphics. "Recording" is to be broadly interpreted as formation of significant and insignificant images, designs, and patterns on the recording medium, or processing of the medium. Further, visualization, to be visually recognized what is recorded by the user, may not necessarily be important.

Furthermore, "recording medium" is not limited to paper, which is generally used in the recording apparatus. "Recording medium" broadly includes any material that can receive ink, such as cloth, plastic film, metal plate, glass, ceramics, wood, and leather.

Moreover, "ink" is to be broadly interpreted similar to "recording (printing)". "Ink" refers to a liquid capable of being used, by applying on the recording medium, for formation of an image, design, and a pattern, processing of the recording medium, and ink processing. An example of ink processing is solidification or insolubilization of a colorant contained in the ink.

According to the above-described exemplary embodiments, when forming the recording image on the recording medium, the periodical density change caused by the periodical position change of the recording head with respect to the recording medium can be reduced.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-191076 filed Aug. 20, 2009, which is hereby incorporated by reference herein in its entirety.

What is claimed is:

1. An information processing apparatus for a recording apparatus that records an image on a recording medium using a recording head including a plurality of recording element arrays arranged in parallel, and in which a plurality of recording elements that discharge recording material is aligned, the information processing apparatus comprising:

an acquisition unit configured to acquire displacement information of an impact position of the recording material recorded by at least one of the plurality of recording element arrays; and a setting unit configured to set a distribution rate of the recording material for each recording element array according to the displacement information, wherein the setting unit sets a larger distribution rate to a recording element array, among the plurality of recording element arrays, whose maximum value of a displacement amount of an impact position of the recording material with respect to a reference recording element array is smaller.

2. An information processing apparatus for a recording apparatus that records an image on a recording medium using a recording head including a plurality of recording element arrays arranged in parallel, and in which a plurality of recording elements that discharge recording material is aligned, the information processing apparatus comprising:

an acquisition unit configured to acquire displacement information of an impact position of the recording material recorded by at least one of the plurality of recording element arrays;

a setting unit configured to set a distribution rate of the recording material for each recording element array according to the displacement information;

an acquisition unit configured to acquire density data of a test pattern printed using the recording head;

a period calculation unit configured to calculate, based on the density data, a period of position change of the recording head with respect to the recording medium; and a displacement amount calculation unit configured to calculate, based on the period of the position change calculated by the period calculation unit, a displacement amount of impact positions of the recording material between the plurality of recording element arrays, wherein the setting unit sets a larger distribution rate to a recording element array, among the plurality of recording element arrays, whose maximum value of a displacement amount of an impact position of the recording material with respect to a reference recording element array is smaller.

3. An information processing method for a recording apparatus that records an image on a recording medium using a recording head including a plurality of recording element arrays arranged in parallel, and in which a plurality of recording elements that discharge recording material is aligned, the information processing method comprising:

acquiring displacement information of an impact position of the recording material recorded by at least one of the plurality of recording element arrays; and setting a distribution rate of the recording material for each recording element array according to the displacement information, wherein setting includes setting a larger distribution rate to a recording element array, among the plurality of recording element arrays, whose maximum value of a displacement amount of an impact position of the recording material with respect to a reference recording element array is smaller.

4. A non-transitory recording medium that stores a program for causing a recording apparatus to perform the information processing method according to claim 3.

5. An information processing apparatus for a recording apparatus that records an image on a recording medium using a recording head including a plurality of recording element arrays arranged in parallel such that recordable areas of the plurality of recording element arrays are overlapped, a plurality of recording elements that discharge recording material being aligned in the plurality of recording element arrays, the information processing apparatus comprising:

an input unit configured to input image data; and a generation unit configured to generate, according to a recording rate of each of a reference recording element array, a first recording element array and a second recording element array among the plurality of recording element arrays, discharge data recorded by the reference recording element array, the first recording element array, and the second recording element array, wherein, in an overlapped recordable area where recordable areas of the reference recording element array, the first recording element array and the second recording element array are overlapped, each of a recording rate of the reference recording element array and a recording rate of any one of the first recording element array and the second recording element array, which has a characteristic similar to a characteristic of an impact position on which recording is performed by a recording element included in the reference recording element array, is larger than a recording rate of the other one of the first recording element array and the second recording element array.

6. An information processing method for a recording apparatus that records an image on a recording medium using a recording head including a plurality of recording element arrays arranged in parallel such that recordable areas of the plurality of recording element arrays are overlapped, a plurality of recording elements that discharge recording material being aligned in the plurality of recording element arrays, the information processing method comprising:

inputting image data; and generating, according to a recording rate of each of a reference recording element array, a first recording element array and a second recording element array among the plurality of recording element arrays, discharge data recorded by the reference recording element array, the first recording element array, and the second recording element array, wherein, in an overlapped recordable area where recordable areas of the reference recording element array, the first recording element array and the second recording element array are overlapped, each of a recording rate of the reference recording element array and a recording rate of any one of the first recording element array and the second recording element array, which has a characteristic similar to a characteristic of an impact position on which recording is performed by a recording element included in the reference recording element array, is larger than a recording rate of the other one of the first recording element array and the second recording element array.

7. A non-transitory recording medium that stores a program for causing a recording apparatus to perform the information processing method according to claim 6.

* * * * *